US008142581B2

(12) United States Patent
Zevenbergen et al.

(10) Patent No.: US 8,142,581 B2
(45) **Date of Patent: *Mar. 27, 2012**

(54) PYROTECHNIC COLOUR COMPOSITION

(75) Inventors: John Franciscus Zevenbergen, Weesp (NL); Rutger Webb, Rotterdam (NL); Murk Pieter Van Rooijen, Stellendam (NL)

(73) Assignee: Clearspark, LLC, Glendale, CA (US)

( * ) Notice: Subject to any disclaimer, the term of this patent is extended or adjusted under 35 U.S.C. 154(b) by 296 days.

This patent is subject to a terminal disclaimer.

(21) Appl. No.: 12/577,081

(22) Filed: Oct. 9, 2009

(65) Prior Publication Data

US 2010/0024931 A1 Feb. 4, 2010

(30) Foreign Application Priority Data

Apr. 16, 2007 (EP) ..... 07106234
Apr. 16, 2008 (WO) ..... PCT/NL2008/050216

(51) Int. Cl.

| | |
|---|---|
| ***C06B 41/00*** | (2006.01) |
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/23

(58) Field of Classification Search ..... 149/23, 149/45, 46, 109.2, 109.4

See application file for complete search history.

(56) References Cited

U.S. PATENT DOCUMENTS

| | | | | |
|---|---|---|---|---|
| 3,657,028 | A * | 4/1972 | Pannell | 149/19.91 |
| 4,078,954 | A | 3/1978 | Bernardy | |
| 5,500,059 | A * | 3/1996 | Lund et al. | 149/19.1 |
| 5,501,823 | A * | 3/1996 | Lund et al. | 264/3.1 |
| 5,917,146 | A | 6/1999 | Hiskey et al. | |
| 6,019,861 | A * | 2/2000 | Canterberry et al. | 149/19.1 |
| 6,156,137 | A * | 12/2000 | Lundstrom et al. | 149/45 |
| 6,214,139 | B1 | 4/2001 | Hiskey et al. | |
| 6,627,014 | B1 * | 9/2003 | Blomquist | 149/45 |
| 6,779,464 | B1 | 8/2004 | Yamato | |
| 2006/0011276 | A1 | 1/2006 | Grix et al. | |
| 2008/0271365 | A1 * | 11/2008 | Goldfarb et al. | 44/642 |
| 2008/0271825 | A1 * | 11/2008 | Halpin et al. | 149/45 |
| 2010/0024931 | A1 * | 2/2010 | Zevenbergen et al. | 149/23 |
| 2010/0024932 | A1 * | 2/2010 | Webb et al. | 149/63 |

FOREIGN PATENT DOCUMENTS

| | | | |
|---|---|---|---|
| DE | 19505568 | A1 | 8/1996 |
| EP | 0536916 | A1 | 4/1993 |
| EP | 1127860 | A1 | 8/2001 |
| JP | 2000297078 | A | 10/2000 |
| WO | 02084458 | A2 | 10/2002 |
| WO | 2006047085 | A2 | 5/2006 |

OTHER PUBLICATIONS

Brill, T. B., et al., "Thermal Decomposition of Energetic Materials 76. Chemical Pathways that Control the Burning Rates of 5-Aminotetrazole and Its Hydrohalide Salts" Combustion and Flame 122:165-171 (2000) received Jan. 3, 2000.

European Search Report, EP1982969 A1, Dated Mar. 14, 2008, Place of Search The Hague.

* cited by examiner

*Primary Examiner* — James McDonough

(74) *Attorney, Agent, or Firm* — Marsh Fischmann & Breyfogle LLP; Kent A. Lembke

(57) ABSTRACT

The invention provides a chlorine-containing pyrotechnic composition which comprises a binder, an oxidator, a pyrotechnic fuel, and a colorant comprising a metal salt of 5-aminotetrazole. The invention further relates to a firework article comprising such a pyrotechnic composition. In addition, the invention provides a method for preparing said colorant.

20 Claims, No Drawings

PYROTECHNIC COLOUR COMPOSITION

RELATION TO OTHER APPLICATIONS

This application claims priority under 35 U.S.C. 371 to international application No. PCT/NL2008/050216 filed on Apr. 16, 2008 which claims priority to EP 07106234.3 filed on Apr. 16, 2007.

BACKGROUND OF THE INVENTION

1. Field of the Invention

The present invention relates to a pyrotechnic composition comprising a 5-aminotetrazole salt, preferably a fireworks composition comprising a 5-aminotetrazole salt.

2. Relevant Background

Conventional colorful fireworks have the major disadvantage that they generate a lot of smoke which causes major problems in enclosed venues as for instance sport stadiums inside cities.

In U.S. Pat. No. 6,214,139 and U.S. Pat. No. 5,917,146 metal salts of several high-nitrogen, low carbon content energetic materials are presented as viable ingredients for low-smoke fireworks compositions.

The high nitrogen, low carbon content energetic materials mentioned in these documents are, however, not readily available compounds. In order to prepare these compounds multi-step syntheses are required. Furthermore, in some of these syntheses environmental unfriendly, toxic or hazardous chemical precursors are required. These two issues increase the price of the metal salts of a high-nitrogen, low-carbon content considerably.

SUMMARY OF THE INVENTION

An object of the present invention is to reduce the environmental impact of fireworks by providing low-smoke, perchlorate-free pyrotechnic compositions that can be used for large scale industrial production of fireworks.

Surprisingly, it has now been found that this object can be realized when use is made of chlorine-containing pyrotechnic compositions which comprise a metal salt of 5-aminotetrazole. The inventors found that a pyrotechnic composition, preferably a firework article, comprising a metal salt of 5-aminotetrazole generates relatively low smoke, while being able to generate colored flames upon combustion. This provides an attractive alternative to the low-smoke pyrotechnic compositions suggested in the prior art, due to the availability of the metal salts. In addition, the synthesis of the components in the pyrotechnic composition and the pyrotechnic composition itself are environmentally friendly. Moreover, even the combustion of the pyrotechnic compositions of the invention can be called environmentally friendly.

Advantageously, the metal salts of 5-aminotetrazole are easy to handle and in addition do not have the risk of self-combustion.

DETAILED DESCRIPTION OF THE PREFERRED EMBODIMENTS

The present invention relates to a chlorine-containing pyrotechnic composition which comprises a binder, an oxidator, a pyrotechnic fuel, and a colorant comprising a metal salt of 5-aminotetrazole.

The metal salt can be obtained by reacting a corresponding metal compound with 5-aminotetrazole. Preferably, the metal salt is obtained by reacting the corresponding metal hydroxide, metal sulphate, metal chloride or metal nitrate with 5-aminotetrazole. More preferably, the metal salt is obtained by reacting the corresponding metal hydroxide or metal nitrate with 5-aminotetrazole. Most preferably, the metal salt is obtained by reacting the corresponding metal hydroxide with 5-aminotetrazole.

The 5-aminotetrazole can either be in anhydrous form or containing crystal water.

Suitably, the metal to be used in the metal salt is selected from the group consisting of calcium, strontium, barium, copper, potassium, iron, magnesium, lithium, boron, titanium, antimony and aluminium.

Preferably, the metal is strontium, barium or copper.

Mixtures of various metal salts can suitably be used to yield desired colors.

Suitably, the binder is present in an amount in the range of from 2-96 wt %, the oxidator is present in an amount in the range of from 1-85 wt %, the pyrotechnic fuel is present in an amount in the range of from 20-96 wt %, and the metal salt of 5-aminotetrazole is present in an amount of from 2-30 wt %, all amounts based n total pyrotechnic composition.

Preferably, the metal salt of 5-aminotetrazole is present in an amount of from 4-10 wt %, based on total pyrotechnic composition.

Suitably, the binder comprises nitrocellulose or PVC. Preferably, the binder comprises nitrocellulose.

Suitably, the nitrocellulose to be used in accordance with the present invention will have a nitrogen content of less than 14 wt %, preferably a nitrogen content in the range of from 12-13.5 wt %.

The binder to be used according to the present invention will usually be extrudable and energetic. With the term energetic is meant that the binder will decompose exothermically.

Suitably, the oxidator is selected from the group consisting of ammonium nitrate, ammonium perchlorate, barium nitrate, barium chlorate, strontium nitrate, potassium nitrate and potassium perchlorate.

Preferably, the oxidator comprises ammonium nitrate or ammonium perchlorate.

The pyrotechnic fuel is selected from the group consisting of nitrocellulose, cellulose, cellulose nitrate, guanidinium nitrate, Arabic gum, red gum and schellack.

Preferably, the pyrotechnic fuel comprises nitrocellulose or cellulose.

It will be clear to the skilled person that nitrocellulose can be used as the binder as well as the pyrotechnic fuel.

The pyrotechnic composition according to the present invention contains chlorine. Suitably, the present pyrotechnic compositions comprise chlorine in an amount in the range of from 0.2-20 wt %, preferably in the range of from 1-5 wt %., based on total pyrotechnic composition.

The chlorine can be provided by the binder, oxidator and/or colorant.

In an attractive embodiment, the metal salt of 5-aminotetrazole is protonated by means of an acid. The protonation can be established by contacting 5-aminotetrazole with hydrochloric acid in a suitable solvent and retrieving the formed crystals.

Suitably, the acid is selected from the group consisting of hydrogen chloride, hydrogen bromide, hydrogen iodide, hydrogen fluoride, nitric acid, chloric acid and perchloric acid.

Preferably, the acid is hydrogen chloride, chloric acid or perchloric acid.

The pyrotechnic composition to be used in accordance with the present invention may include other conventional components (burn rate modifier, stabilizer, processing additives, flegmatizer, etc.) which are common for those skilled in the art. If present, these components will be present in an amount of less than 10 wt %, based on total pyrotechnic composition.

The present invention also relates to a firework article comprising the pyrotechnic composition in accordance with the present invention.

In addition, the present invention relates to the use of a metal salt of 5-aminotetrazole as described hereinabove in a firework article. More in particular, the invention relates to the use of a metal salt of 5-aminotetrazole as described herein in a low-smoke pyrotechnic composition. The pyrotechnic composition of the invention, in particular when used in a firework article, can generate colored flames upon combustion while generating only very little smoke in comparison with conventional pyrotechnic compositions. Preferably pyrotechnic composition is essentially smoke-free.

The present invention further relates to a method for preparing the colorant of the pyrotechnic composition according to the present invention, which method comprises reacting for instance a metal hydroxide or a metal nitrate with 5-aminotetrazole, and recovering the colorant in the form of the metal salt of 5-aminotetrazole so obtained.

Suitably, said process is carried out in the presence of water.

The pyrotechnic composition according to the invention can suitably be made by dry mixing the respective components and pressing the composition so obtained in the desired form. In another embodiment, the respective components are mixed in the presence of a solvent, after which the mixture obtained is extruded, and the solvent is removed by means of evaporation.

The solvent can suitable be selected from the group consisting of ethanol or solvent esters such as ethyl acetate, butyl acetate, or alcohols such as isopropanol butanol. Such solvents have the advantage, when compared with conventionally used solvents such as acetone and hexane, that they have less impact on the environment and reduce the risk of safety hazards (explosions) considerably. Preferably, the solvent comprises acetone.

The solvent is suitably present in an amount in the range of from 0 to 20 wt %, based on total pyrotechnic composition. Preferably, the solvent is present in an amount in the range of from 5 to 14 wt %, based on total mixture. It will be understood by the skilled person that said solvent will in essence not be present in the pyrotechnic composition eventually obtained, due to evaporation of the solvent concerned.

EXAMPLES

Example 1

A pyrotechnic composition according to the present description was prepared having the following composition: 94.8 wt % Nitrocellulose (13.5% N); 5 wt % Strontium-aminotetrazole complex; and 0.2 wt % ammonium chloride.

The pyrotechnic composition was prepared by mixing 100 gram dry NC 13.5% with 5.27 gram Strontium Amino-tetrazole complex and 0.22 gram ammonium chloride. Acetone was then added to the mixture, and the mixture thus obtained was mixed until the composition can be shape formed in a ram extrusion process in strands of 10 mm diameter. The acetone was removed at room temperature. The strands so obtained are cut in pellets of 10 mm length which pellets are further processed into a firework article. The firework article burnt with a red flame.

Example 2

A pyrotechnic composition according to the present description was prepared having the following composition: 83 wt % Ammonium Nitrate; 6 wt % Barium-aminotetrazole complex with hydrochloride; 11 wt % Nitrocellulose (13.5% $N_2$).

Said pyrotechnic composition was dry mixed in a turbulator. After mixing the composition was pressed in pellets of 15 mm diameter. The composition so prepared burnt with a green flame.

Example 3

A pyrotechnic composition according to the present description was prepared having the following composition: 48 wt % Ammonium perchlorate; 17 wt % Aminotetrazole; 5 wt % Strontium-aminotetrazole complex; 30 wt % Nitrocellulose (13.5% $N_2$. The pyrotechnic composition was dry mixed in a turbulator. After mixing, the composition was pressed in pellets of 15 mm diameter. The composition so prepared burnt with a red flame.

We claim:

1. A chlorine-containing pyrotechnic composition which comprises a binder, an oxidator, a pyrotechnic fuel, and a colorant comprising a metal salt of 5-aminotetrazole.

2. A composition according to claim 1, wherein the metal salt is obtained by reacting the corresponding metal hydroxide or metal nitrate with 5-aminotetrazole.

3. A composition according to claim 2, wherein the metal salt is obtained by reacting the corresponding metal hydroxide with 5-aminotetrazole.

4. A composition according to any one of claims 1-3, wherein the metal is selected from the group consisting of calcium, strontium, barium, copper, potassium, iron, magnesium, lithium, boron, titanium, antimony and aluminium.

5. A composition according to claim 4, wherein the metal is strontium, barium or copper.

6. A composition according to claim 1, wherein the binder is present in an amount in the range of from 2-20 wt %, the oxidator is present in an amount in the range of from 1-85 wt %, the pyrotechnic fuel is present in an amount in the range of from 20-96 wt %, and the metal salt of 5-aminotetrazole is present in an amount of from 2 to 30 wt %, all amounts based on total pyrotechnic composition.

7. A composition according to claim 6, wherein the metal salt of 5-aminotetrazole is present in an amount of from 4 to 10 wt %, all amounts based on total pyrotechnic composition.

8. A composition according to claim 1, wherein the binder comprises nitrocellulose or PVC.

9. A composition according to claim 8, wherein the binder comprises nitrocellulose.

10. A composition according to claim 1, wherein the oxidator is selected from the group consisting of ammonium nitrate, ammonium perchlorate, barium nitrate, barium chlorate, strontium nitrate, potassium nitrate and potassium perchlorate.

11. A composition according to claim 8, wherein the oxidator comprises ammonium nitrate or ammonium perchlorate.

12. A composition according to claim 1, wherein the pyrotechnic fuel is selected from the group consisting of nitrocellulose, cellulose, cellulose nitrate, guanidinium nitrate, Arabic gum, red gum and schellack.

13. A composition according to claim 12, wherein the pyrotechnic fuel comprises nitrocellulose or cellulose.

14. A composition according to claim 1, wherein the metal salt of 5-aminotetrazole is protonated by means of an acid.

15. A composition according to claim 14, wherein the acid is selected from the group consisting of hydrogen chloride, hydrogen bromide, hydrogen iodide, hydrogen fluoride, nitric acid, chloric acid and perchloric acid.

16. A composition according to claim 15, wherein the acid comprises hydrogen chloride, chloric acid or perchloric acid.

17. A pyrotechnic composition comprising:

a binder;

an oxidator;

a pyrotechnic fuel, wherein at least one of the binder and the pyrotechnic fuel comprise nitrocellulose; and a colorant comprising a metal salt of 5-aminotetrazole, wherein the pyrotechnic composition further comprises chlorine.

18. The composition of claim 17, wherein the oxidator is one or more oxidators selected from the group consisting of: ammonium nitrate, barium nitrate, barium chlorate, strontium nitrate, and potassium nitrate.

19. The composition of claim 17, wherein the metal salt of 5-aminotetrazole is present in an amount of from 4 to 10 wt %, all amounts based on total pyrotechnic composition.

20. The composition of claim 17, wherein the metal salt of 5-aminotetrazole is protonated with an acid selected from the group consisting of hydrogen chloride, hydrogen bromide, hydrogen iodide, hydrogen fluoride, nitric acid, chloric acid and perchloric acid.

* * * * *